United States Patent [19]

Seshimo

[11] Patent Number: 5,030,024

[45] Date of Patent: Jul. 9, 1991

[54] SHEET FEEDING DEVICE IN A PRINTER

[75] Inventor: Tatsuya Seshimo, Nagano, Japan

[73] Assignee: Seiko Epson Corporation, Tokyo, Japan

[21] Appl. No.: 402,853

[22] Filed: Sep. 6, 1989

[30] Foreign Application Priority Data

Sep. 6, 1988 [JP] Japan ..... 63-223783

[51] Int. Cl.[5] ..... B41J 11/50

[52] U.S. Cl. ..... 400/605; 400/616; 400/618; 400/636.1; 400/637

[58] Field of Search ..... 400/637, 607, 624, 625, 400/626, 627, 578, 599, 605, 608.1, 634, 582, 583, 585, 585.1, 595, 596, 703, 706, 708, 708.1, 616, 616.2, 711, 703, 618, 636, 636.1

[56] References Cited

U.S. PATENT DOCUMENTS

| | | | |
|---|---|---|---|
| 4,569,611 | 2/1986 | Tomoyoshi et al. | 400/624 |
| 4,607,968 | 8/1986 | Carena | 400/637 X |
| 4,688,957 | 8/1987 | Prevignano | 400/625 X |
| 4,708,504 | 11/1987 | Asakura | 400/637 |
| 4,802,780 | 2/1989 | Yokoi | 400/605 X |

FOREIGN PATENT DOCUMENTS

| | | | |
|---|---|---|---|
| 0026890 | 9/1980 | European Pat. Off. . | |
| 0227116 | 7/1987 | Fed. Rep. of Germany | 400/605 |
| 205182 | 12/1982 | Japan | 400/605 |

*Primary Examiner*—Edgar S. Burr
*Assistant Examiner*—Moshe I. Cohen
*Attorney, Agent, or Firm*—Cushman, Darby & Cushman

[57] ABSTRACT

A printer system having a sheet feeding device for selectively feeding one of a single sheet and a continuous includes a platen arranged adjacent a printing unit; a sheet detector disposed on a sheet feeding path along which the single and continuous sheets are fed, for detecting the presence of one of the single and continuous sheets; a sheet feeder positioned near the platen, for feeding one of the single and continuous sheets to a predetermined position; a selector for selecting one of a single-sheet feeding mode and a continuous-sheet feeding mode; and a sheet feeding and removing switch for allowing the sheet feeder to operate to feed and remove out of the single and continuous sheets.

5 Claims, 7 Drawing Sheets

SHEET FEEDING DEVICE IN A PRINTER

BACKGROUND OF THE INVENTION

1. Field of the Invention

This invention relates to a sheet feeding device for use in a printer in which a continuous printing sheet such as a fanfold paper (hereinafter referred to as "a continuous sheet") and a single printing sheet such as a cut paper (hereinafter referred to as "a single sheet") are fed for printing operation.

2. Prior Art

Some of the printers, which are output devices of a computer, are able to use both a continuous sheet such as a fan-fold paper and a single sheet such as a cut paper. In such a printer, the fan-fold paper is fed with a push tractor disposed in front of a platen, and the cut paper is fed by rotation of the platen itself.

In order to effectively feed the papers, Japanese Patent Application (OPI) No. 145052/1985 has disclosed a printer which has two holding rollers below the platen (the term "OPI" as used herein means an "unexamined published application"). In the printer, a fan-fold paper feeding mode and a cut paper feeding mode are switched over to each other according to the kind of printing paper to be used. That is, in the fan-fold paper feeding mode, the roller further from the printing head is abutted against the platen to lead the paper, and then the two rollers are moved away from the platen. In the cut paper feeding mode, only the roller closer to the printing head is abutted against the platen.

The above-described conventional printer is advantageous in that, since it is so designed that the roller further from the printing head is abutted against the platen, the printing sheet can be readily loaded. However, it is still disadvantageous in the following points: Even if, as shown in FIG. 1 (Prior Art), the front end portion of the printing sheet s is fed to the platen c with the aid of the roller a and a guide board b, in order to let it go along the platen c it is necessary to provide an auxiliary sheet guide board d so as to forcibly lay the printing sheet over the platen. In this case, the printing sheet, striking against the auxiliary sheet guide board d, is held unstable; i.e., slackened between the roller a and the auxiliary sheet guide board d. Therefore, in a printer in which the peripheral speed of the platen c is higher than the sheet feeding speed of the push tractor e, the slackening of the printing sheet is gradually absorbed during the sheet feeding operation, as a result of which the print position is shifted as much as the slackening. Furthermore, in the cut paper feeding operation, the cut paper cannot be sufficiently fed with only the roller closer to the printing head.

A sheet feeding device in a printer, which can use both a continuous sheet and a single sheet by switching the continuous sheet feeding mode and the single sheet feeding mode over to each other as was described above, has been also disclosed by Japanese Patent Application (OPI) No. 205182/1982. In the device, in order to use a single sheet, its change-over lever is shifted to interrupt the transmission of the torque of an electric motor to the pin tractor, so that the single sheet can be fed with a pair of drawing rollers without removal of the continuous sheet from the pin tractor. That is, in the device, the continuous sheet feeding mode and the single sheet feeding mode are switched over to each other by operating the change-over lever only. Therefore, the sheet feeding device is unavoidably intricate in construction. Furthermore, the operation of the device is rather troublesome because the change-over lever must be operated frequently.

SUMMARY OF THE INVENTION

An object of this invention is to eliminate the above-described difficulties accompanying a conventional sheet feeding device for use in a printer which uses both a single sheet and a continuous sheet.

More specifically, an object of the invention is to provide a sheet feeding device for use in a printer which uses both a single sheet and a continuous sheet in which, when a continuous sheet is used, it is not slackened, and, when a single sheet is used, it is positively fed.

Another object of the invention is to provide a sheet feeding device for a printer which uses both a single sheet and a continuous sheet in which switching a single-sheet feeding mode and a continuous-sheet feeding mode over to each other is positively achieved through cooperation of selecting means for selecting one of the single-sheet feeding mode and continuous-sheet feeding mode and sheet feeding and removing switch means for allowing sheet feeding means to operate to feed or remove the single sheet or continuous sheet, and which device is simple in construction and accordingly excellent in operability.

DETAILED DESCRIPTION OF THE PREFERRED EMBODIMENTS

Figure 1:
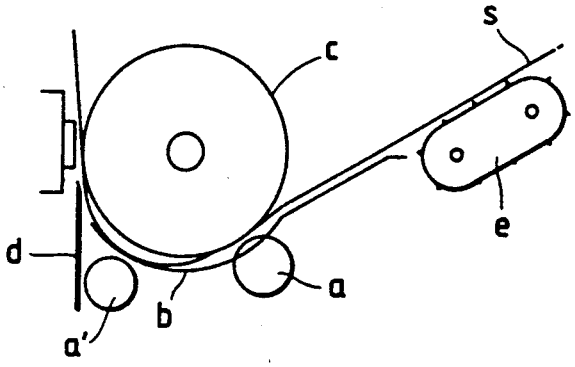
FIG. 1 PRIOR ART
FIG. 1 (Prior Art) shows a conventional sheet feeding device in a printer.
Figure 2:
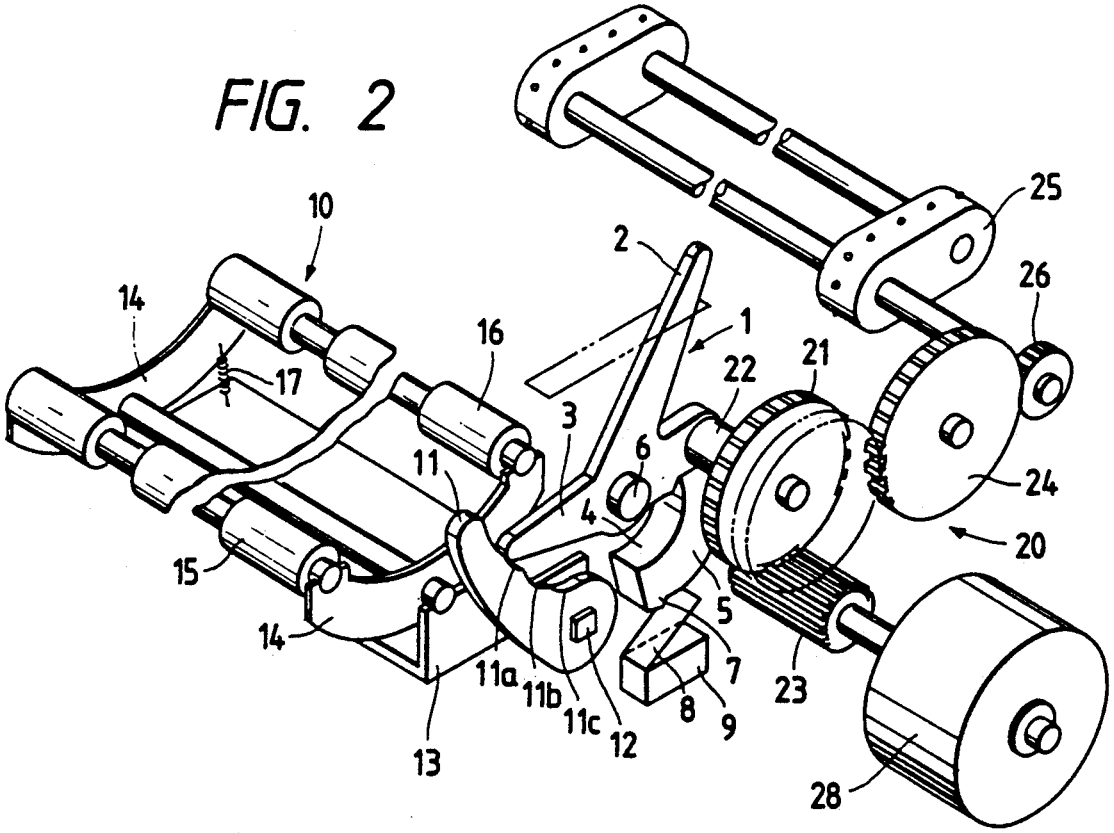
FIG. 2 is a perspective view showing a sheet feeding device in a printer body according to the present invention.

Referring to FIGS. 2 and 3, a sheet feeding device built in a printer body according to this invention will be described.

In these figures, reference numeral 1 designates an operating lever for displacing a sheet feeding unit 10 (described later) according to the kind of a recording sheet S. The operating lever 1 comprises: an operating arm 2 protruding above the upper surface of the printer body (not shown) so that it can be operated by the hand; a unit displacing arm 3 acting on the sheet feeding unit 10 to displace the latter 10; and an arm 4. The arm 4 has a cam 5 which acts on a drive force transmission gear train 20 to bring a part of the gear train into engagement or disengagement, and a switch depressing cam 7 which depresses a lever position detecting switch 9 to detect positions a, b and c (described later). The operating lever 1 thus constructed is of three-pronged form and rotatably mounted on a shaft 6 secured to a printer frame.

Figure 3A:
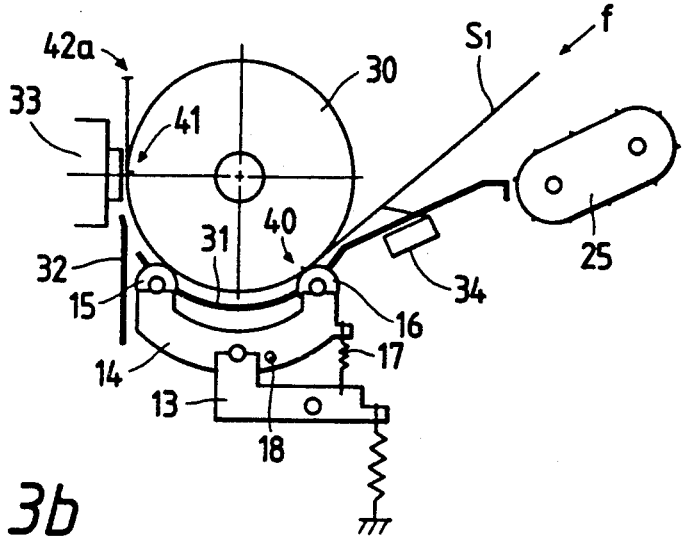
FIGS. 3*a* through 3*c* are side views showing a single-sheet feeding position, and two different continuous-sheet feeding positions, respectively.
Figure 3B:
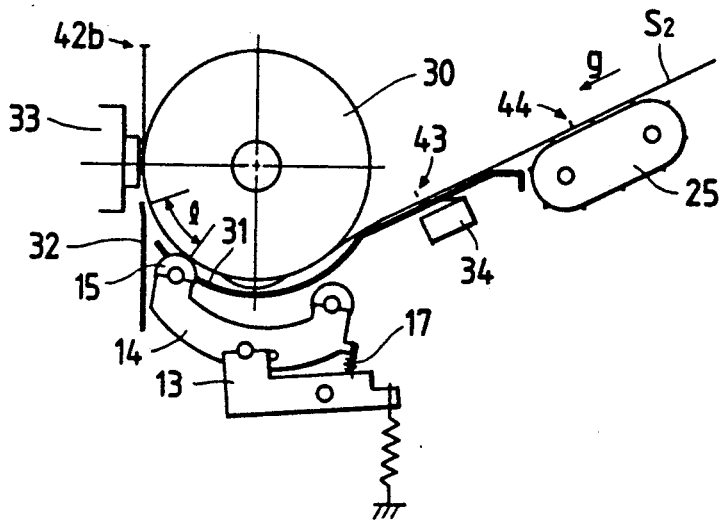
Figure 3C:
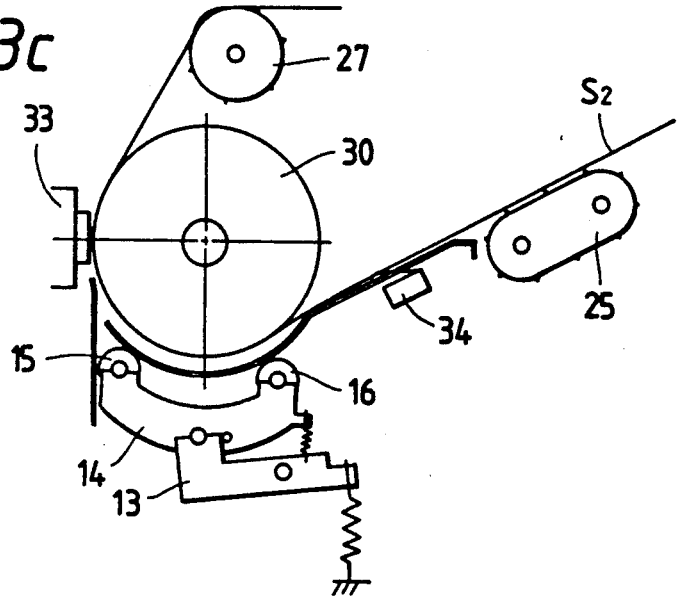

On the other hand, the aforementioned sheet feeding unit 10 is to change a recording sheet feeding operation according to the kind of the recording sheet used and the sheet feeding mode selected. The unit 10 comprises a sheet feeding lever 13 and a driven lever 11 which are mounted on a common shaft 12 so that they are operated as one unit. Those levers 13 and 11 are turned by the operating lever 1 which is engaged with the driven lever 11. The driven lever 11 has a slide edge with which the unit displacing arm 3 is slidably engaged. More specifically, the driven lever 11 has three arcuate recesses 11*a*, 11*b* and 11*c* along the slide edge so that the. driven lever 11 takes three turning positions being depressed by the unit displacing arm 3. The sheet feeding lever 13 integral with the driven lever 11 has a roller holder 14 at one end thereof in such a manner that the roller holder 14 is rockable. The roller holder 14 has front rollers 15 at the one end closer to a printing head 33 and rear rollers 16 at the other end, respectively. The rear rollers 16 of the roller holder 14 are pulled by a weak tension spring 17 connected to the sheet feeding lever 13. Therefore, when the driven lever 11 is at a single-sheet ($S_1$) feed position, i.e., when the end of the unit displacing arm 3 is engaged with the first recess 11*a*, as shown in FIG. 3*a*, the sheet feeding lever 13 is turned clockwise to push the rollers 15 and 16 against a platen 30. When the driven lever 11 is at a continuous sheet ($S_2$) push tractor feed position, i.e., when the end of the unit displacing arm 3 is engaged with the second recess 11*b*, as shown in FIG. 3*b*, the sheet feeding lever 13 is turned one step counterclockwise, so that the roller holder 14 is slightly moved away from the platen 30 while it is turned clockwise by the tension spring 17, as a result of which only the front rollers 15 is held in light contact with the platen 30. When the driven lever 11 is at a continuous sheet ($S_2$) pull tractor feed position; i.e., when the end of the unit displacing arm 3 is engaged with the third recess 11*c*, as shown in FIG. 3*c*, the sheet feeding lever 13 is further turned counterclockwise, so that both the rollers 15 and 16 are spaced away from the platen 30.

Further, in FIG. 2, reference numeral 21 designates a first intermediate gear of the push tractor drive gear train 20, which is mounted on a shaft 22 in such a manner that it is movable in the direction of axis while being engaged with a piniOn 23 of a drive motor 28. One end of the shaft 22 of the first intermediate gear 21 is abutted against the arm 4 of the operating lever 1, so that, due to the cam 5 of the arm 4, the first intermediate gear 21 is disengaged from a second intermediate gear 24 when the operating lever 1 is at the single-sheet feed position, and it is engaged with the second intermediate gear 24 when the operating lever 1 is at the continuous sheet feed position (the push tractor feed position or pull tractor feed position) whereby the torque of the drive motor 28 is transmitted through the pinion 23, the first intermediate gear 21, the second intermediate gear 24, and a pinion 26 engaged with the gear 24 to the push tractor 25.

The aforementioned lever position detecting switch 9 is disposed near the operating lever 1. When the operating lever 1 is at the single-sheet feed position, the switch 9 is turned off. When the operating lever 1 is at the continuous sheet feed position (the push tractor feed position or pull tractor feed position), the actuator 8 of the switch 9 is depressed by the cam 7 of the arm 4 of the operating lever 1 so that the switch 9 is turned on. Thus, it can be determined whether the operating mode is the single-sheet feed mode or the continuous-sheet feed mode.

Figure 4:
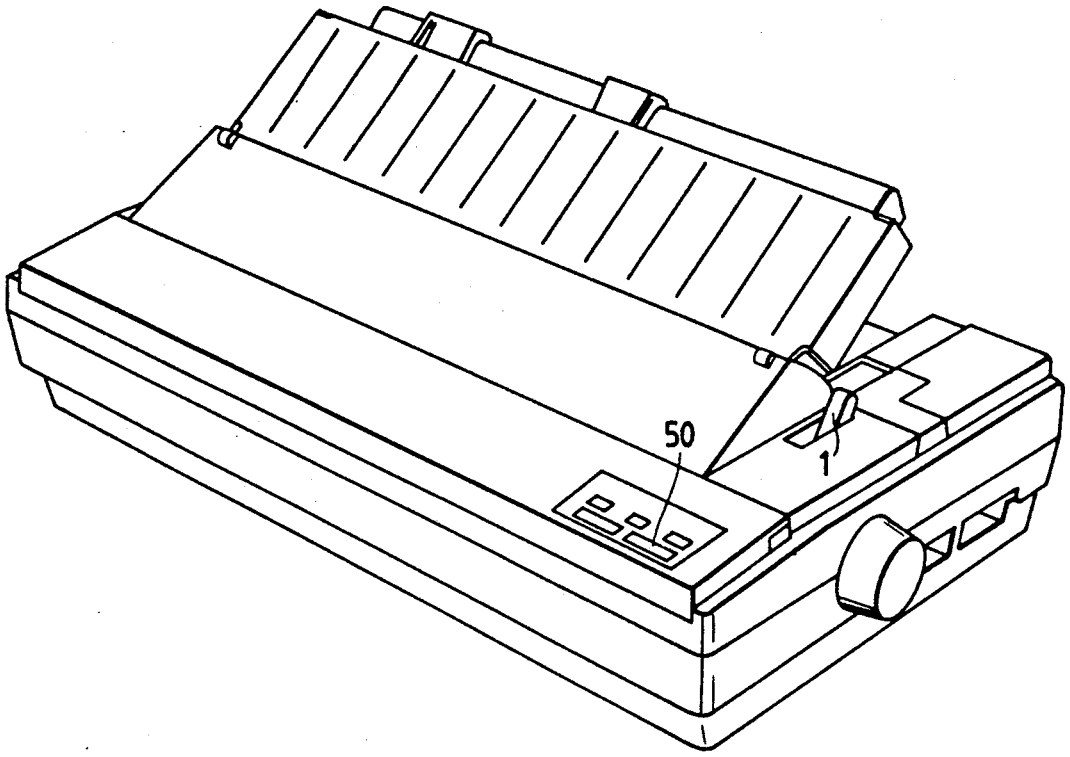
FIGS. 4 is a perspective view showing a sheet feed switch provided on the upper cover of the printer body.

In FIG. 3*a*, reference numeral 18 designates a stopper pin on the sheet feeding unit 10; 31, a guide board; 32, an auxiliary sheet guide board; 33, a printing head; and 34, a sheet presence detecting switch provided in the path along which a recording sheet S is moved. The platen 30 is so designed that, with the aid of a power transmission mechanism (not shown) the torque of the drive motor 28 is transmitted to the platen 30 irrespective of the engagement or disengagement of the first and second intermediate gears 21 and 24. In FIG. 3*c*, reference numeral 27 designates a pull tractor disposed downstream of the printing head 33. The pull tractor 27 is so designed that, with the aid of a power transmission mechanism (not shown), it pulls the continuous sheet $S_2$ at the speed equal to that of the push tractor 25, as is well known in the art. A switch 50 for transmitting a recording sheet feeding instruction signal (hereinafter referred to as "a sheet feed switch") is provided on the upper surface of the printer body, as shown in FIG. 4.

Figure 5A:
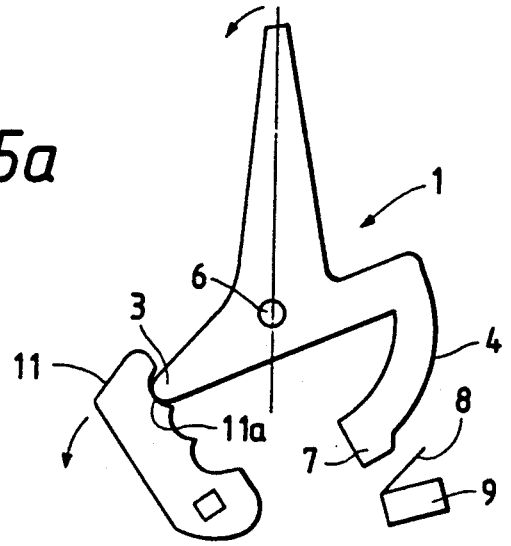
FIGS. 5*a* through 5*c* are side views showing the positional relationships between an operating lever, a driven lever, and a lever position detecting switch.

In printing data on a single sheet $S_1$ such as a cut sheet with the printer thus constructed, the operating lever 1 is first turned to a position shown in FIG. 5*a*. As a result, the arm 4 of the operating lever 1 shifts the first intermediate gear 21 to the lowest part of the cam 5 of the arm 4, relatively, so that the first intermediate gear 21 is disengaged from the second intermediate gear 24, while the lever position detecting switch 9 is held turned off because the cam 7 does not act on it. Thus, it can be determined that the single-sheet feeding position has been attained.

At the same time, the end of the unit displacing arm 3 is engaged with the first recess 11*a* of the driven lever 11; that is, the lever 11 is held at the single-sheet feed position. Accordingly, as shown in FIG. 3*a*, the sheet feeding lever 13 integral with the driven lever 11 pushes the roller holder 14 upwardly, so that the front and rear rollers 15 and 16 are abutted against the platen 30. As a result, the single sheet $S_1$ fed along the platen 30 is brought into close contact with the platen 30, so that the sheet is positively fed by rotation of the platen 30.

Upon operation of the sheet feed switch 50, setting the single sheet $S_1$ and removing the single sheet printed are carried out, respectively, which will be described with respect to FIGS. 6, 7*a*, and 7*b*.

Figure 6:
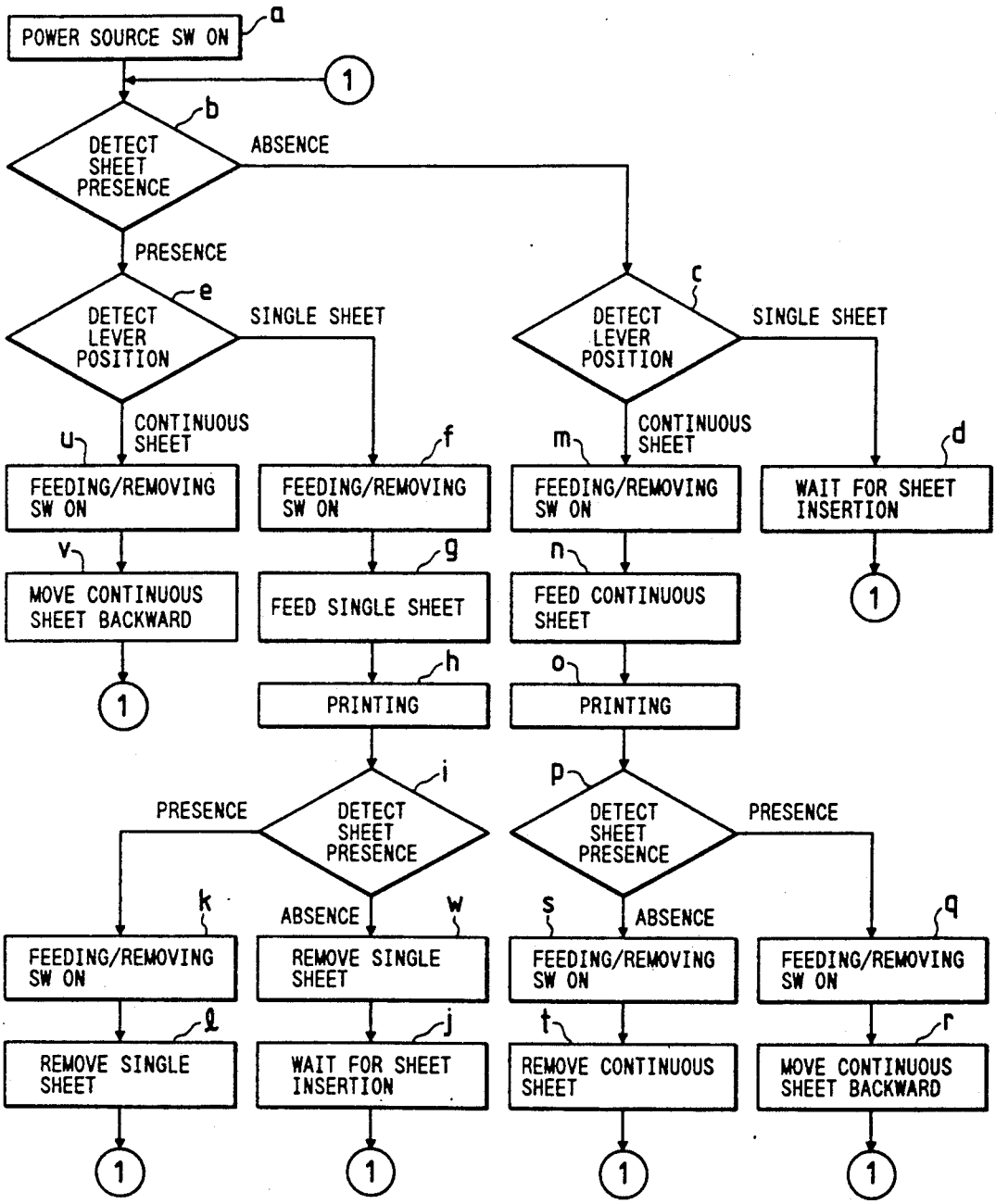
FIG. 6 is a flow chart showing the sheet feeding operation according to the present invention.
Figure 7A:
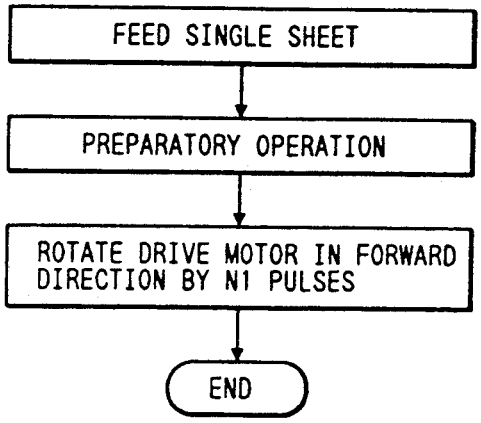
FIGS. 7*a* through 7*d* are flow charts showing the operation of setting and removing single- and continuous-sheets according to the present invention, respectively.
Figure 7B:
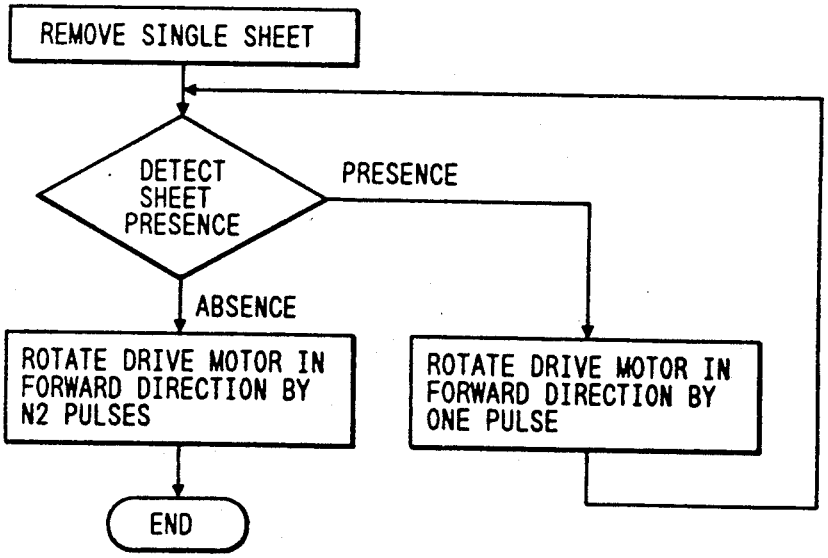

First, a switch for power supply is turned on (Step a of FIG. 6). When it has been detected that no sheet exists in Step b, the printer is then held waiting for insertion of a printing sheet until insertion of the printing sheet in the Step d, after it is detected that the operating lever 1 is at the single-sheet feed position in Step C. When a single sheet $S_1$ is inserted into the printer, the front edge of the single sheet is abutted against the nipping region 40 of the platen 30 and the rear rollers 16; that is, it is positioned in place, while the sheet presence detecting switch 34 disposed along the path of the single sheet $S_1$ operates to detect the insertion of the sheet in Step b. That is, in the printer body, it has been determined that the operating lever 1 is at the single-sheet feed position in Step e, and the sheet presence detecting switch 34 has detected the presence of the sheet.

When, under this condition, the sheet feed switch is operated (Step f), as shown in a flow chart of FIG. 7*a*, the drive motor 28 is turned by a predetermined amount, N1 pulses, in the forward direction to feed the single sheet $S_1$ from the position 40 to a position 42*a* above a printing position 41 (herein after referred to as "a peak top position") as shown in FIG. 3*a*, and then it is stopped (Step g). Thus, the single sheet $S_1$ has been set in the printer body.

As the printing operation is carried out (Step h), the sheet presence detecting switch 34 will detect the rear edge of the single sheet $S_1$, that is, the absence of the sheet (Step i). Thereupon, the printer is again held waiting for insertion of another sheet (Step j) after, in response to the detection of the rear end, the motor 28 is turned in the forward direction as much as a predetermined amount, N2 pulses to remove the single sheet S1 (Step w), as indicated in the flow chart of FIG. 6.

On the other hand, after completion of the printing operation, in the case where the sheet presence detecting switch 34 detects the presence of the sheet (Step i), the single sheet $S_1$ printed must be removed in order to insert another sheet into the printer. In this case, in the printer body, it has been detected that the operating lever 1 is at the single-sheet feed position, and the sheet presence detecting switch 34 is in "sheet presence state". When, under this condition, the sheet feed switch 50 is operated again (Step k), then the drive motor 28 is maintained driven in the forward direction until the sheet presence detecting switch 34 detects the rear edge of the single sheet $S_1$. Thereafter, in response to the detection of the rear edge, the motor 28 is further turned as much as a predetermined amount, N2 pulses, to remove the single sheet $S_1$ (Step l). Then, the printer is held waiting for insertion of the following sheet (See FIG. 7*b*).

Figure 5B:
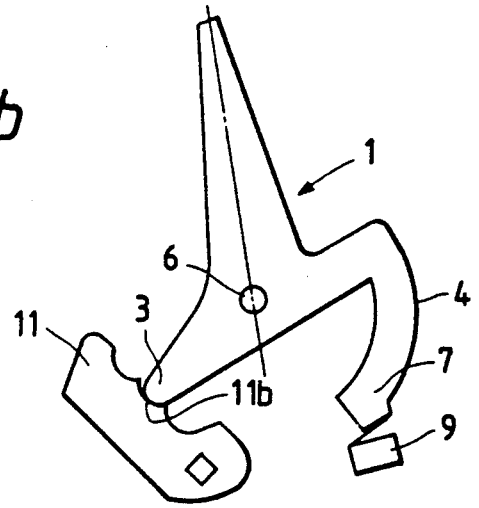

In the case where a continuous sheet $S_2$ such as a fan-fold sheet is used as a printing sheet, the operating lever 1 is turned counterclockwise in FIG. 2 so that it comes to the second position, that is, the push tractor feed position as shown in FIG. 5*b*. As a result, the first intermediate gear 21 abutted against the lowest part of the arm 4 is pushed up along the surface of the cam 5 of the arm 4, to engage with the second intermediate gear 24 thereby transmitting the torque of the motor to the push tractor 25, while the cam 7 of the arm 4 depresses the actuator 8 of the lever position detecting switch 9 to turn on the switch 9. Thus it has been detected that the continuous-sheet feed position has been attained.

At the same time, the end of the unit displacing arm 3 is engaged with the second recess 11*b* of the driven lever 11 while pushing the driven lever 11 counterclockwise. In this operation, the sheet feeding lever 13 integral with the driven lever 11 is turned counterclockwise, so that the roller holder 14 coupled to the sheet feeding lever 13 is slightly moved away from the platen 30. As a result, the roller holder 14 is slightly turned clockwise because the rear rollers 16 are pulled by the weak tension spring 17, so that only the front rollers 15 are brought into soft contact with the cylindrical wall of the platen 30 (FIG. 3*b*).

Thus, the switching of the sheet feeding unit 10 and the drive gear train 20 by the operating lever 1 has been accomplished.

Figure 7C:
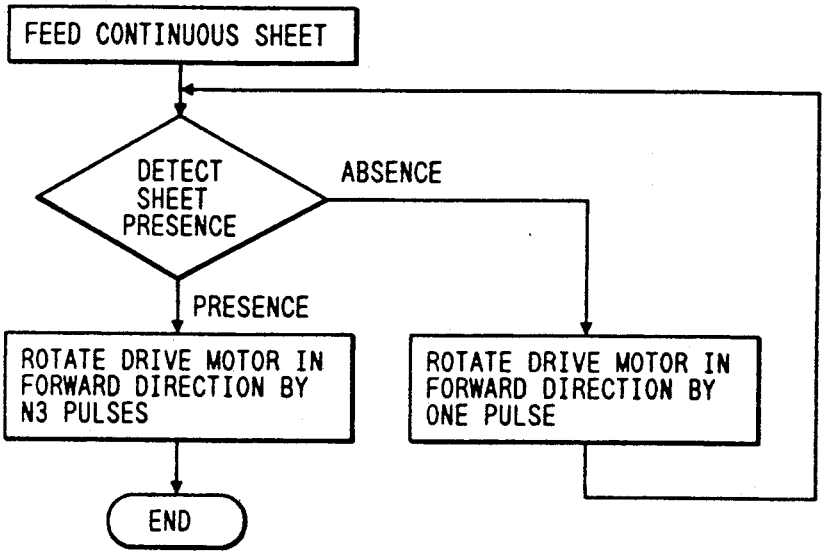

The continuous sheet $S_2$ is started in response to the operation of the sheet feed switch 50 similarly as in the case of the single sheet $S_1$, which will be described according to flow charts shown in FIGS. 6 and 7*c*.

First, before insertion of a sheet, that is, in the case where the printer body has detected that the sheet presence detecting switch 34 is in the sheet absence state (Step b) and the operating lever 1 is at the continuous-sheet feed position (Step c), the sheet feed switch 50 is operated (Step m). As a result, the drive motor 28 is turned in the forward direction, and the torque thereof is transmitted through the pinion 23, the first intermediate gear 21, the second intermediate gear 24 and the pinion 26 of the push tractor 25 to drive the latter 25 thereby to feed the continuous sheet $S_2$ (Step n). The continuous sheet $S_2$ is fed in the direction of the arrow g of FIG. 3*b* while being guided by the guide board 31. When the front edge of the continuous sheet $S_2$ reaches the position 43, the sheet presence detecting switch 34 is operated to detect the insertion of the continuous sheet $S_2$. Thereafter, in response to the detection of the sheet presence, the drive motor 28 is turned in the forward direction as much as a predetermined amount, $N_3$ pulses, as indicated in the flow chart of FIG. 7*c*. As a result, the front edge of the continuous sheet $S_2$ is sent to the peripheral surface of the platen 30 with the sheet being supported by the front rollers 15, and then to the peak top position 42*b* with the sheet being guided by the auxiliary sheet guide board 32. Thus, the continuous sheet $S_2$ has been set in the printer body.

The continuous sheet $S_2$ is relatively high in stiffness. Therefore, even if the continuous sheet fed along the guide board 32 is partially slackened, it is extended along the platen 30 while being simply supported by the front rollers 15 closer to the printing head 33. Therefore, the continuous sheet $S_2$ will never be slackened over a slight distance l (FIG. 3*b*) downstream of the front rollers 15, so that the printing is accurately carried out.

Figure 7D:
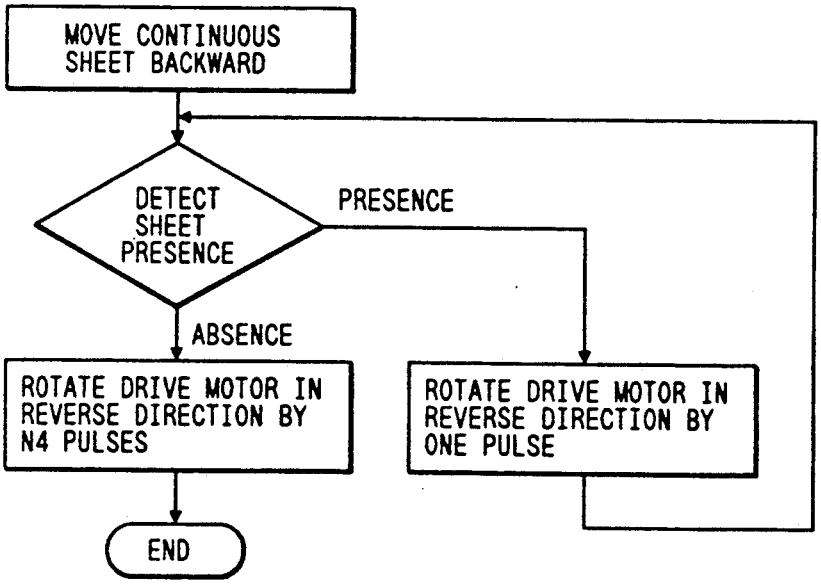

After the printing operation has been carried out (Step o), in the case where the recording sheet is replaced by another one, the printer body has detected that the operating lever 1 is at the single-sheet feed position and the sheet presence detecting switch 34 is in a sheet presence state (Step p). Therefore, when the sheet feed switch 50 is operated again (Step q), the continuous sheet $S_2$ is moved backwardly (Step r). First, the drive motor 28 is rotated in the reverse direction. When the front edge of the sheet $S_2$ comes to the position 43 as the sheet is pulled by the push tractor 25, the sheet presence detecting switch 34 will detect the end of the continuous sheet $S_2$. Under this condition, as indicated in FIG. 7*d*, the drive motor 28 is further turned in the reverse direction as much as a predetermined amount, N4 pulses, as a result of which the continuous sheet $S_2$ is moved backwardly to the extent that a single sheet can be readily inserted and the continuous sheet $S_2$ is still over the push tractor 25; in other words, the continuous sheet is moved backwardly until its front end comes to a position 44 shown in FIG. 3*b*. Thus, the continuous sheet has been moved backwardly, and the printer is ready for insertion of a recording sheet.

On the contrary, in the case where the sheet presence detecting switch 34 detects the absence of the continuous sheet, that is, the rear edge of the sheet, the sheet feed switch 50 is operated (Step s) so that the motor 28 is turned in the forward direction as much as a predetermined amount $N_5$ to remove the continuous sheet $S_2$ (Step t).

Further, in the case where the sheet presence detecting switch 34 detects the presence of the sheet (Step b) and the operating lever 1 is at the continuoussheet feed position (Step e), the sheet feed switch is operated so that the continuous sheet $S_2$ is moved backwardly, in the same way as Step r. Upon completion of Step r, the continuous sheet is then moved forwardly as in Step n to set the continuous sheet in position for printing.

Figure 5C:
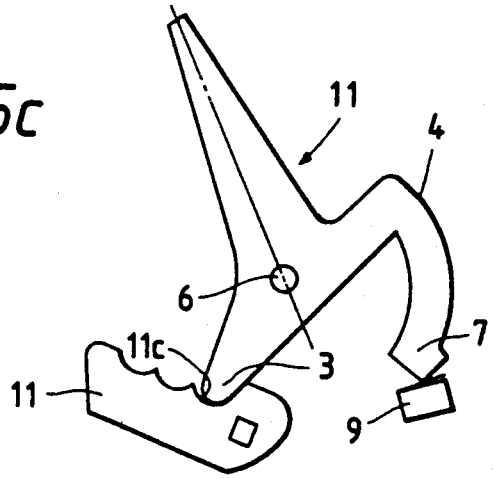

In the case where the continuous sheet $S_2$ is fed by means of both of the push tractor 25 and the pull tractor 27, the operating lever 1 is further turned counterclockwise, as shown in FIG. 5*c*. As a result, the sheet feeding lever 13 is further turned through the driven lever 11 by the unit displacing arm 3 counterclockwise, so that the roller holder 14 mounted on the unit displacing lever 3 is moved away from the platen 30. That is, both of the front and rear rollers 15 and 16 are spaced away from the platen 30. Accordingly, the continuous sheet $S_2$ laid over the push tractor 25 and the pull tractor 27 is held in light contact with the platen 30. Hence, even when the platen is rotated at a peripheral speed higher than that of the tractors 25 and 27, the sheet is fed correctly.

Figure 8:
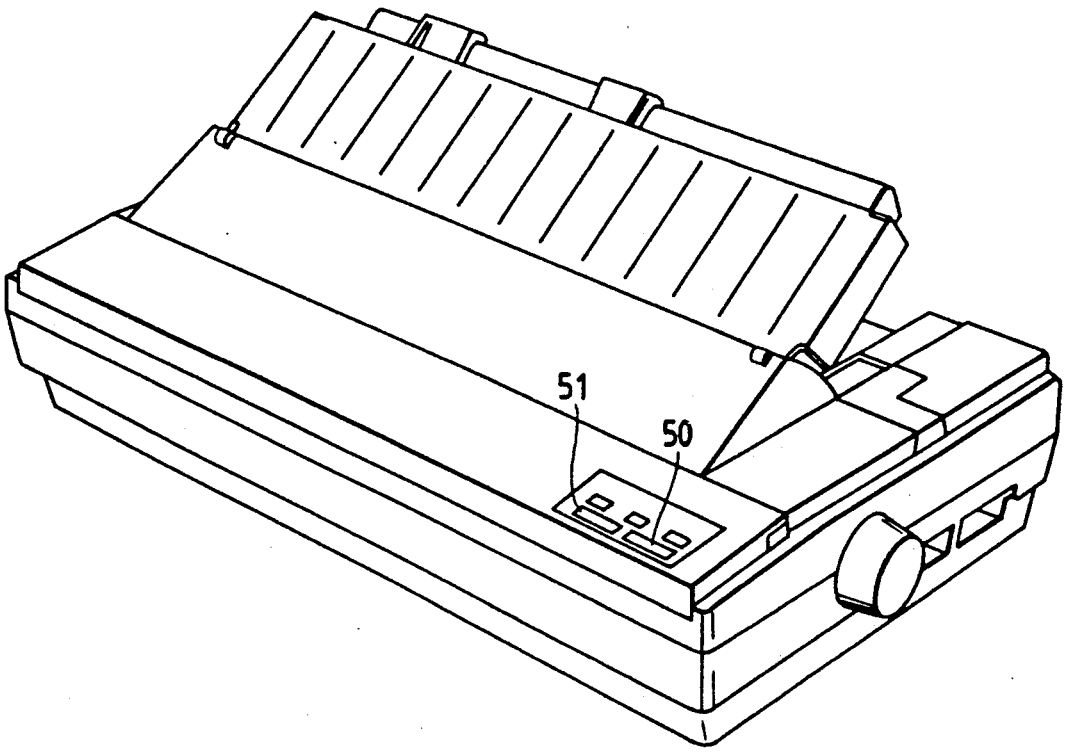
FIG. 8 is a perspective view showing a sheet selection switch disposed on the printer body instead of an operating lever.

In the above-described sheet feeding device, not only a single-sheet feeding operation is carried out, but also a continuous-sheet feeding operation is performed by the push tractor feed method or the pull tractor feed method. However, the object of the invention can be achieved without using the pull tractor feed method. Furthermore, the operating lever 1 is not limited only to that which has been described above. That is, it may be replaced by any member which functions equally, for example, a sheet selection switch 51 shown in FIG. 8.

As was described above, in the sheet feeding device according to the invention, the roller holder having the first rollers close to the printing head and the second rollers remote from the printing head is provided near the platen, and the roller holder is displaced so that both of the first and second rollers are abutted against the platen, only the first rollers close to the printing head are brought into contact with the platen, or both of the first and second rollers are spaced away from the platen. Therefore, in the case of the single sheet, it is abutted against the platen with the aid of the first and second rollers, so that it is positively fed. In the case of the continuous sheet, the first rollers close to the platen are brought into light contact with the platen, so that the sheet is prevented from being slackened downstream of the first rollers, whereby the printing operation is achieved with high accuracy. Alternatively, the continuous sheet can be fed correctly with the first and second rollers being spaced away from the platen, using both the push tractor and the pull tractor.

Furthermore, in the sheet feeding device of the invention, the printing sheets and the sheet feeding modes are switched through the cooperation of the selecting means for selecting one of the single sheet feeding mode and one of two different continuous-sheet feeding modes, and the sheet feeding and removing switch means, and therefore the switching operations are positively achieved. Thus, the sheet feeding device of the invention is excellent in operability and simple in construction.

What is claimed is:

1. A printer system having a sheet feeding device for selectively feeding one of a single sheet and a continuous sheet, comprising:

printing means for printing said sheets;

platen means arranged adjacent said printing means supporting said sheets;

a sheet detector disposed on a sheet feeding path along which said single and continuous sheets are selectively fed for detecting the presence of one of said single and continuous sheets;

sheet feeding means positioned adjacent said platen means and before said printing means on said sheet feeding path, for feeding one of said single and continuous sheets to a predetermined position, said sheet feeding means comprising: a pair of rollers including a first roller close to said printing means and a second roller remote from said printing means; and roller holding means arranged near said platen means for holding said pair of rollers, said sheet detector disposed on said sheet feeding path before said platen means and said sheet feeding means, wherein said roller holding means is movable such that each roller can be pressed against said platen means and each roller can be moved away from said platen means;

selecting means for selecting one of a single-sheet feeding mode and a continuous-sheet feeding mode, said selecting means also causing said roller holding means to take a first position where both said first and second rollers press against said platen means, and a second position where only said first roller presses against said platen means; and sheet feeding and removing switch means for allowing said sheet feeding means to operate to feed and remove one of said single and continuous sheets.

2. A printer system as claimed in claim 1, wherein when said sheet detector detects the presence of any of said single and continuous sheets and said selecting means selects said continuous-sheet feeding mode, said continuous sheet is moved in a backward direction by turning on said sheet feeding and removing switch.

3. A printer system as claimed in claim 1, wherein turning on said sheet feeding and removing switch means causes said single sheet to be fed to said platen means by said sheet feeding means when sheet detector detects the presence of any of said single and continuous sheets and said selecting means is in a single-sheet feeding mode.

4. A printer system as claimed in claim 1, wherein turning on said sheet feeding and removing switch means causes said continuous sheet to be fed to said platen means by said sheet feeding means when said sheet detector detects the absence of any of said single and continuous sheets and said selecting means is in a continuous-sheet feeding mode.

5. A feeding device as claimed in claim 1, wherein said operating means further causes said roller holding means to take a third position where both said first and second rollers are spaced away from said platen means.

* * * * *